United States Patent [19]

Popovitch

[11] Patent Number: 4,662,279

[45] Date of Patent: May 5, 1987

[54] SAFING AND ARMING DEVICE

[75] Inventor: Dragolyoub Popovitch, Denville, N.J.

[73] Assignee: Interdyne Service Corp., North Tarrytown, N.Y.

[21] Appl. No.: 778,989

[22] Filed: Sep. 23, 1985

[51] Int. Cl.[4] ..... F42C 15/26

[52] U.S. Cl. ..... 102/233; 102/240; 102/235; 102/245

[58] Field of Search ..... 102/232, 240, 231, 233, 102/237, 238, 239, 247, 249, 245, 253, 235

[56] References Cited

U.S. PATENT DOCUMENTS

| | | | |
|---|---|---|---|
| 1,545,866 | 7/1925 | Van Essen | 102/247 |
| 4,242,963 | 1/1981 | Ziemba | 102/245 |

FOREIGN PATENT DOCUMENTS

| | | | |
|---|---|---|---|
| 27061 | 1/1921 | Denmark | 102/240 |
| 2435693 | 5/1976 | Fed. Rep. of Germany | 102/240 |

*Primary Examiner*—Stephen C. Bentley
*Assistant Examiner*—Stephen M. Johnson
*Attorney, Agent, or Firm*—William J. Ruano

[57] ABSTRACT

In a weapon subject to a sequence of high acceleration followed by high spin and including a detonator and an explosive charge; the improvement comprising a barrier located between the detonator and explosive charge to normally form an obstruction to prevent accidental detonation of the explosive charge by the detonator. Mechanical locking means are provided to lock the barrier in place, comprising a spirally wound ribbon, a pair of pins restraining the outer surface of the ribbon to prevent premature unwinding, and a pair of superimposed anti-friction balls mounted on a hub portion of the ribbon, the upper ball being seated in an extension portion of the barrier. When the weapon is fired from a gun, the high acceleration will remove the pins and allow the ribbon to unwind. Upon unwinding the entire ribbon, the balls will be released and the barrier under the action of spin, will be removed to provide an unobstructed path between the detonator and explosive charge.

4 Claims, 2 Drawing Figures

SAFING AND ARMING DEVICE

This invention relates to a safing and arming (S & A) device which forms an integral part of a small cailber (or even high caliber) explosive shell fired at high velocity from an internally-rifled gun.

The invention is primarily intended for use in conjunction with rapid-fire small caliber weapons. This being the case, the main factors motivating this invention are:

(a) The very small volume available for insuring the safing and arming function; and (b) The requirement that the resulting device be simple and cheap to manufacture.

BACKGROUND OF THE INVENTION

An outstanding disadvantage of present safing and arming devices is that they usually require a source of electrical power, such as a battery, which through shelfage may become inoperable; therefore, making the device undependable as well as adding to size and weight of the device.

Another disadvantage is that such devices often are not dependable to assure against accidental explosion before the shell is a safe distance away from the firing gun.

An object of the present invention is to provide a novel safing and arming device which will overcome the above-named disadvantages.

A more specific object of the invention is to provide a safing and arming device which requires no electrical energy for its operation; therefore can be made extremely small in size and light in weight, as well as relatively inexpensive to manufacture.

Another object of the invention is to provide a novel safing and arming device which is operable only after a predetermined acceleration followed by a predetermined amount of spin of the shell carrying the device before detonation of the explosive charge; therefore insuring a high degree of safety.

BRIEF DESCRIPTION OF THE DRAWING

Other objects and advantages of the invention will become more apparent from a study of the following description taken with the accompanying drawing wherein.

DESCRIPTION OF THE PREFERRED EMBODIMENT

Figure 1:
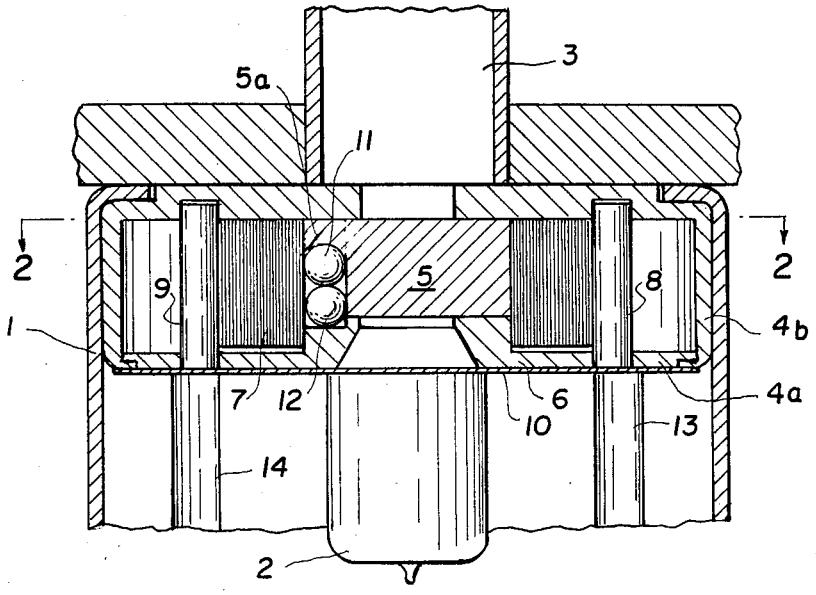
FIG. 1 is a vertical cross-sectional view taken along line 1—1 of FIG. 2 of a safing and arming device embodying the present invention.
Figure 2:
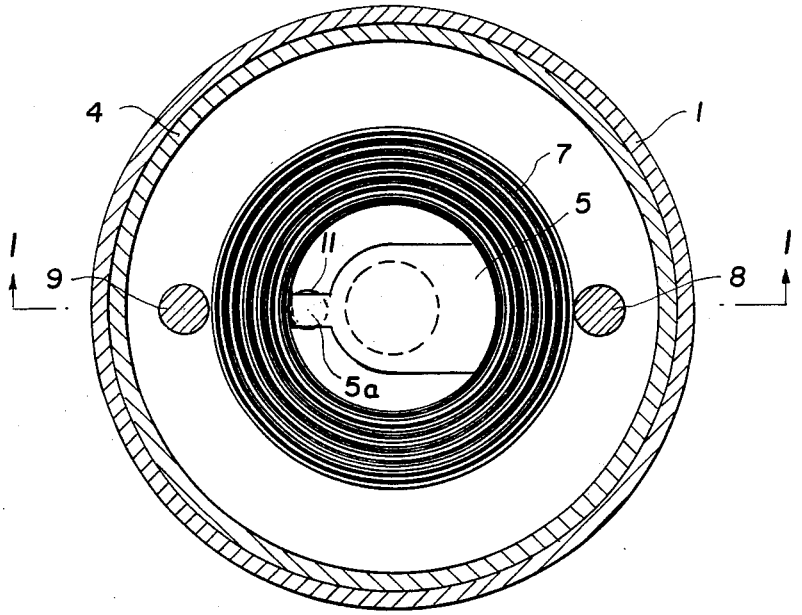
FIG. 2 is a top sectional view thereof taken along line 2—2 of FIG. 1.

Referring more particularly to FIGS. 1 and 2, numeral 1 denotes a casing for housing an assembly of fuze parts, together with a detonator 2. Above the casing 1, there is an explosive charge 3 contained in a cylindrical portion of the assembly.

The present invention is specifically directed to the safing and arming device forming an integral part of a small caliber explosive shell, which device is contained in the housing consisting of a base 4*a* and of a cover 4*b*. The device comprises a barrier 5 for obstructing the path between detonator 2 and explosive charge 3, which barrier is supported on a hub 6, around which is wound a spiral ribbon 7, preferably of metal, of a predetermined number of turns depending upon the minimum distance from the gun at which detonation is permitted to take place.

Set-back pins 8 and 9 in the positions shown, that is, contacting the outer surface of ribbon 7, will prevent unwinding of the ribbon. Barrier 5 has an integral extension 5*a* which has a surface of an appropriate shape for seating an anti-friction ball 11 which rests on top of an anti-friction ball 12. Both balls 11 and 12 normally rest in a groove within the hub 6, with the ball 11 restrained by the ball 12 which, in turn, is restrained by the ribbon 7, thus locking the barrier 5 in place. A membrane 10 completes the enclosure of the spiral ribbon and associated parts, so that in the normal position, shown in FIG. 1, barrier 5 prevents any accidental setting off by the detonator 2 of the explosive charge 3. That membrane or foil may be manufactured either as a separate part pressed against the bottom of the housing, as shown in FIG. 1, or as an integral part of the housing base 4*a*.

In operation, when the shell having the above-described safing and arming device is fired from a gun which is internally rifled, it will be ejected through the muzzle of the gun at high velocity and high spin because of the internal rifling. Thus, under the influence of high acceleration and high initial set-back, the set-back pins 8 and 9 will puncture holes in membrane 10 and will be forced downwardly into holes 13 and 14 in either tubes or in a solid mass below membrane 10. When the set-back pins 8 and 9 move into holes 13 and 14, the spin will move them radially outwardly against outermost walls of the pockets or holes 13 and 14, since the diameters of holes 13 and 14 are larger in an outward direction than those of pins 8 and 9, as will be apparent in FIG. 1.

This will prevent return of the pins back into their normal or upper position as might otherwise happen later. Thereupon, the ribbon 7, by virtue of spin of the projectile and S & A device, will unwind, and upon complete unwinding thereof, and with the ribbon out of the way, ball 12 followed by ball 11, under the action of spin, will move radially outwardly into the space previously occupied by spiral ribbon 7. Since the center-of-gravity of the barrier 5 is offset outwardly from the spin axis, the barrier will be moved, by spin, completely away from the path existing between detonator 2 and the high explosive charge 3, thereby allowing detonation of the charge because of removal of the obstacle provided by barrier 5. For example—one layer of coil may unwind or peel off while the unit makes one revolution, equivalent to a travel equal to about 30 calibers. The larger the number of turns, the greater the safe arming distance away from the firing gun.

It should be noted that the present invention is limited in use to rounds that are fired with high acceleration from an internally rifled gun so as to provide the round or projectile with spin. Therefore, it is not applicable to ordinary mortar shells or rockets.

Thus it will be seen that I have provided a safing and arming unit 4 which may be of very small size, since it requires a small number of simple parts, and which is responsive to the combination of high acceleration or set-back followed by high spin to remove the barrier and permit the setting off of the explosive charge by the detonator, thereby assuring that the explosive charge will not be accidentally detonated during storage, handling, transportation or even after firing until the shell is at a safe distance from the firing gun.

While I have illustrated and described a single specific embodiment of my invention, it will be understood that this is by way of illustration only and that various changes and modifications may be contemplated in my invention within the scope of the following claims.

I claim:

1. In a weapon subject to a sequence of acceleration followed by spin, including a detonator and an explosive charge, the improvement comprising a barrier located between said detonator and explosive charge to normally form an obstruction to prevent accidental detonation of said explosive charge by said detonator, said barrier having a center-of-gravity offset radially outwardly of the axis of spin sufficiently so as to be completely removable laterally as an obstruction between said detonator and explosive charge, mechanical locking means devoid of a source of electrical power for its operation for normally locking said barrier in place to provide said obstruction, said mechanical locking means including a spirally wound ribbon wrapped around said barrier, restraining means normally engaging an outer surface of said spirally wound ribbon to prevent premature unwinding of said ribbon, said restraining means being responsive to said acceleration to disengage said ribbon and permit unwinding thereof as a consequence of said spin, said mechanical locking means also comprising locking elements restrained by the inner leaves of said spirally wound ribbon and normally locking said barrier in place, said locking elements being responsive to a predetermined number of spins to unlock and remove said barrier laterally and provide an unobstructed path between said detonator and explosive charge.

2. A weapon as recited in claim 1 wherein said restraining means comprises a pair of pins located diametrically opposite the outer surface of said spirally wound ribbon and held in place by a thin foil normally engaging one end of said pins and which can be punctured by said pins under high acceleration or set back to remove the pins from restraining engagement with said outer surface of said ribbon.

3. The weapon recited in claim 2 together with means for receiving said pins after puncturing said foil, comprising tubular receptacles of substantially larger diameter than said pins in a radially outward direction from the spin axis.

4. A weapon as recited in claim 1, wherein said locking elements comprise a pair of superimposed anti-friction balls, an integral finger portion of said barrier seating a top portion of the uppermost superimposed anti-friction ball.

* * * * *